United States Patent [19]

Wollank

[11] 4,398,128

[45] Aug. 9, 1983

[54] METHOD AND CIRCUIT ARRANGEMENT FOR HEATING AND IGNITING AS WELL AS CONTROLLING OR REGULATING THE LIGHT FLUX OF LOW-PRESSURE GAS-DISCHARGE LAMPS

[75] Inventor: Gerhard Wollank, Brühl-Heide, Fed. Rep. of Germany

[73] Assignee: Brown, Boveri & Cie Aktiengesellschaft, Mannheim, Fed. Rep. of Germany

[21] Appl. No.: 340,747

[22] Filed: Jan. 19, 1982

[30] Foreign Application Priority Data

Jan. 20, 1981 [DE] Fed. Rep. of Germany ..... 3101568

[51] Int. Cl.[3] ..... H05B 37/02

[52] U.S. Cl. ..... 315/158; 315/119; 315/209 SC; 315/244; 315/DIG. 2

[58] Field of Search ..... 315/DIG. 2, 209 R, 209 SC, 315/244, 151, 158, 119

[56] References Cited

U.S. PATENT DOCUMENTS

| | | | |
|---|---|---|---|
| 3,449,629 | 6/1969 | Wiggert | 315/158 |
| 3,514,668 | 5/1970 | Johnson | 315/205 |
| 3,753,071 | 8/1973 | Engel et al. | 315/DIG. 7 |
| 4,017,761 | 4/1977 | Woldring | 315/244 |
| 4,207,497 | 6/1980 | Chapwell et al. | 315/96 |
| 4,251,752 | 2/1981 | Stolz | 315/206 |

*Primary Examiner*—Harold A. Dixon

*Attorney, Agent, or Firm*—Herbert L. Lerner; Laurence A. Greenberg

[57] ABSTRACT

Method for heating and igniting as well as controlling or regulating the light flux of low-pressure gas-discharge lamps, including a ballast having an inverter for generating an ac voltage at inverter output terminals from a dc voltage generated from an ac supply network by rectifiers, the ac voltage having a frequency higher than line frequency, the ballast including an L-C circuit having a capacitor and a first choke connected between one of the inverter output terminals and a lamp, the lamp being in turn connected to another of the inverter output terminals, a second choke shunted across the lamp, the charge of the capacitor being constantly reversed by the inverter with controllable frequency, which comprises changing the inverter frequency in accordance with the desired light flux with constant ac voltage amplitude at the outputs of the inverter, tuning the frequency, voltage, capacitor, first choke and second choke to each other, circulating substantially the required heating current through heating coils of the lamp at low frequency before the lamp is ignited, decreasing the heating current at rising frequency until substantially 40% of the rated light flux of the lamp is reached after the lamp is ignited, and decreasing the heating current to less than 25% of its initial value as the frequency continues to rise until the rated light flux of the lamp is reached, and an apparatus for carrying out the method.

18 Claims, 13 Drawing Figures

METHOD AND CIRCUIT ARRANGEMENT FOR HEATING AND IGNITING AS WELL AS CONTROLLING OR REGULATING THE LIGHT FLUX OF LOW-PRESSURE GAS-DISCHARGE LAMPS

The invention relates to a method and a circuit arrangement for heating and igniting as well as controlling or regulating the light flux of low-pressure gas-discharge lamps, especially fluorescent lamps, by means of a series-connected device (such as a ballast), in which an inverter generates an ac voltage of a frequency higher than the line frequency, from a dc voltage generated by means of rectifiers from an ac supply network, there being inserted between the inverter output and the low-pressure gas-discharge lamp, an LC-circuit including a capacitor and a first choke, the low-pressure gas-discharge lamp being shunted by a second choke, and the inverter constantly reversing the capacitor charge with a controlled frequency.

Such a circuit arrangement is known, for instance, from U.S. Pat. No. 4,207,497. The known circuit includes a dc-fed inverter formed of two series-connected thyristors with an antiparallel diode. An LC-circuit tuned to the inverter frequency leads to the primary winding of an output transformer from the connecting point of two thyristors. The secondary winding of the transformer may have up to 40 fluorescent lamps connected thereto, each through a separate ballast. Each ballast includes an LC-circuit in series with the fluorescent lamp and a choke or capacitor in shunt with the fluorescent lamp. The brightness of the fluorescent lamps is obtained by suitably driving the inverter thyristor and the amplitude control of the ac voltage resulting therefrom feeding the fluorescent lamps.

One significant disadvantage of the known circuit is based on the use of the single LC-circuit in the lead to the primary transformer winding. This LC-circuit must be constructed in such a way that it will transmit the electric power required to feed all fluorescent lamps which are connected at the fixed inverter frequency. If one or more fluorescent lamps fail, this LC-circuit is not tuned correctly, so that impermissibly high voltages can occur which may destroy the inverter thyristors, puncture the insulation of the lines, and endanger the operating or maintenance personnel.

Another disadvantage of the known circuit is that a separate wire must go from the central inverter to each of the up to 40 fluorescent lamps, to conduct the voltages and currents of relatively high frequency. This entails the danger of undesirable high-frequency radiation; for this reason, the lines in the known device must be shielded by means of a steel tube.

In other lighting systems with fluorescent lamps, iron-core chokes tuned to the line frequency and compensated by means of capacitors, are also used as ballasts. Phase gating devices are used to control or regulate the light flux. This requires special fluorescent lamps or fluorescent lamps with ignition assists and additional heating transformers for proper operation. Due to the need for heating transformers, special sockets are also required for contacting the fluorescent lamp with screw connections, which makes the replacement of the fluorescent lamps much more difficult. Such lighting systems have considerable power losses, due to the iron-core choke ballast, the heating transformers, and the generation of reactive power in the phase gating device.

In addition, the phase gating device itself produces radio interference which must be prevented from spreading to the wiring, by means of interference suppression elements and shields. Moreover, fluorescent lamps intended specifically for operation with variable brightness are almost twice as expensive as standard fluorescent lamps.

It is accordingly an object of the invention to provide a method and device for heating and igniting as well as controlling or regulating the light flux of low-pressure gas-discharge lamps, especially fluorescent lamps, which overcomes the hereinafore-mentioned disadvantages of the heretofore-known methods and devices of this general type, through which the power losses can be reduced substantially, the light yield of the fluorescent lamp is increased, a variation of the light flux illumination is possible without flicker between about 1% and 100% of the rated light flux with no impermissibly high voltages occuring when a defective lamp is replaced, and which can be constructed by using commercial components.

With the foregoing and other objects in view, there provided, in accordance with the invention, a method for heating and igniting as well as controlling or regulating the light flux of low-pressure gas-discharge lamps, including a ballast having an inverter for generating an ac voltage at inverter output terminals from a dc voltage generated from an ac supply network by rectifiers, the ac voltage having a frequency higher than line frequency, the ballast including an L-C circuit having a capacitor and a first choke connected between one of the inverter output terminals and a lamp, the lamp being in turn connected to another of the inverter output terminals, a second choke shunted across the lamp, the charge of the capacitor being constantly reversed by the inverter with controllable frequency, which comprises changing the inverter frequency in accordance with the desired light flux with constant ac voltage amplitude at the outputs of the inverter, tuning the frequency, voltage, capacitor, first choke and second choke to each other, circulating substantially the required heating current through heating coils of the lamp at low frequency before the lamp is ignited, decreasing the heating current at rising frequency until substantially 40% of the rated light flux of the lamp is reached after the lamp is ignited, and decreasing the heating current to less than 25% of its initial value as the frequency continues to rise until the rated light flux of the lamp is reached.

In the present invention, only direct current is carried by the wiring because the actual inverter and the ignition circuit associated therewith are contained in a ballast associated with each lighting fixture, the ballast for each low-pressure gas-discharge lamp connected thereto containing a separate ballast LC-circuit and a separate shunt choke. This greatly reduces the radio interference transmitted through the wiring lines.

Another advantage results from controlling the light flux through the frequency, where the preheating of the heating coils, and the low light fluxes or lighting intensities are obtained at low frequencies and the maximum light fluxes or lighting intensities are obtained at high frequencies. A known fact which is utilized is that low-pressure gas-discharged lamps emit greater light fluxes at the same power consumption when fed by ac voltages of higher frequency, or that the same light fluxes are obtained at reduced electric power consumption. Another advantage of the frequency control is that when the chokes and capacitors connected to the low-pressure gas-discharge lamp are suitably tuned, the current for preheating the heating coils can be reduced just as steadily for steadily increasing lamp brightness, without requiring mechanical or electronic switching elements for this purpose.

Another advantage results from the use of a single series-connected LC-member for each low-pressure gas-discharge lamp, which member, moreover, is not tuned to the resonance frequency of the feeding ac voltage. This is why it is not only the components themselves which remain small and inexpensive, but also the electric power transmittable by them, so that no overvoltages harmful to the operating or maintenance personnel can occur in case of the failure or replacement of a defective low-pressure gas-discharge lamp.

In accordance with another mode of the invention, there is provided a method which comprises keeping the frequency constant at a given low value for a given time span after turning on the ballast until the heating coils reach their required or specified temperature, and subsequently steadily increasing the frequency to a value corresponding to the desired light flux. It is therefore made certain, in this manner, that the ignition voltage required to trigger the gas discharge is reached only after the heating coils have reached their specified emission temperature. This increases the life of the fluorescent lamps considerably, and the disturbing flicker when turning on the low-pressure gas-discharge lamps is eliminated.

In accordance with the apparatus of the invention, there is provided a circuit for carrying out a method for heating and igniting as well as controlling or regulating the light flux of low-pressure gas-discharge lamps, each lamp having two heating coils each having two terminals, comprising an inverter having output terminals for converting a dc voltage into an ac voltage of higher frequency at the output terminals, the inverter including two semiconductor switches receiving the dc voltage and being connected together in series and two antiparallel connected diodes each being respectively connected to one of the switches, one of the inverter output terminals being connected to one terminal of one coil of a lamp, at least one series circuit for increasing lamp current through the lamp with increasing frequency and for decreasing heating current through the heating coils of the lamp, each of the at least one series circuit including a first choke and a capacitor connected in series between another of the inverter output terminals and one terminal of the other coil of the lamp, a second choke shunted across the other terminals of the coils of the lamp, and at least one frequency generator connected to the inverter for generating an ac ignition pulse voltage as a function of a given desired light flux for alternately switching the switches on and off.

Such a circuit arrangement has the advantage that it can be constructed of conventional components and with small dimensions, so that a separate ballast with an inverter and several chokes and capacitors can be associated with each lighting fixture according to the number of low-pressure gas-discharge lamps installed in the fixture. The dc voltage for a multiplicity of such ballasts can be generated centrally and distributed simply to the individual lighting fixtures through wiring lines. Furthermore, the control voltage controlling the inverters and determining the light flux of the low-pressure gas-discharge lamps is generated centrally and fed to each ballast as a low-power ac ignition pulse voltage through a separate line which may be connected parallel to the dc lines.

In accordance with a further feature of the invention, the semiconductor switches are thyristors and the at least one frequency generator is in the form of two ignition pulse generators respectively forming and delivering the ac ignition pulse voltage as ignition pulses to one of the thyristors, each of the ignition pulse generators including a decoupling diode separating positive and negative parts of the ac ignition pulse voltage, a unijunction transistor having a power or main circuit and a resistor and a capacitor connected to the decoupling diode, and an ignition transformer having a primary winding connected to the power circuit of the unijunction transistor, and a secondary winding connected to the respective thyristor for furnishing ignition pulses therefrom formed from the ac ignition pulse voltage.

This circuit arrangement has the advantages that the ignition pulse generator transforms the ac ignition pulse voltage directly into ignition pulses of suitable form and power without the help of additional supply voltages for firing the main thyristors of the inverter, and that the use of thyristors permits very simple, operationally safe and rugged inverters which can operate at a sufficiently high frequency. Backwards-conducting thyristors can especially be fired with frequencies above the audible range of the human ear, so that the ballasts cannot emit disturbing sound signals.

In accordance with an added feature of the invention, each of the ignition transformers has another secondary winding, and including two parallel-connected RC-members each being connected between one of the other secondary windings and the thyristor connected to the other respective transformer. This prevents an ignition of the cut-off thyristor because the critical rate of rise of the voltage was exceeded. Due to this simple measure, it is also possible to use thyristors in the inverter which are not specifically constructed for a high permissible rate of voltage rise.

In accordance with an additional feature of the invention, the respective thyristor and antiparallel-connected diode are in the form of backward conducting thyristors.

In accordance with again another feature of the invention, the first choke is split into two choke parts, one of the choke parts being disposed upstream of the lamp and the other being disposed downstream thereof.

In accordance with again a further feature of the invention, the first choke has two windings, one of the windings being disposed upstream of the lamp and the other being disposed downstream thereof. In this way, the series choke can simultaneously act as a radio interference suppression choke for the radio interference originating in the low-pressure gas-discharge lamp itself.

In accordance with again an added feature of the invention, at least one other lamp is connected in series with the first-mentioned lamp, and the second choke is split into two choke parts, each one of the choke parts being shunted across a respective one of the lamps.

In accordance with again an additional feature of the invention, at least one other lamp is connected in series with the first-mentioned lamp, and the second choke includes a plurality of windings, each one of the windings being shunted across a respective one of the lamps.

This arrangement is suggested for low-pressure gas-discharge lamps of low power consumption, e.g. 20 W, because the number of components required can thus be reduced further.

In accordance with yet another feature of the invention, there is provided a potentiometer for setting a desired light flux of the lamp, and an integrating control connected to the potentiometer and to the frequency generator for driving the frequency generator with a defined acceleration or starting up curve. The defined starting-up curve assures that, as already mentioned, approximately the specified heating current flows through the heating coils before the ignition of the low-pressure gas-discharge lamp at low frequency; the heating current decreasing only insignificantly after the ignition of the low-pressure gas-discharge lamp with increasing frequency until about 40% of the rated light current is reached; and gradually decreasing to less than 25% of its initial value as the frequency continues to increase, until the rated light flux is reached. In this manner, the frequency is adjusted according to the optimum low-pressure gas-discharge lamp characteristic, and the lamps themselves reach their maximum life in this manner.

In accordance with yet a further feature of the invention, the frequency generator is in the form of a voltage-controlled pulse generator forming voltage blocks of alternating polarity and a pulse width inversely proportional to the frequency. The "on" time of the voltage blocks thus becomes shorter with rising frequency. At less than 20% of the light flux, the inverter thyristors receive ignition pulses of about 20 μsec duration, shortened to about 4 μsec at 100% light flux. This assures safe and low-loss switching of the inverter thyristors under all operating conditions.

In accordance with yet an added feature of the invention, there is provided a light-sensitive component for measuring actual light flux of the lamp, and an integrating control connected to the light-sensitive component and the inverter for comparing desired and actual light flux. The light-sensitive component may be a photodiode, a phototransistor, or a photoresistor, for example. Due to this supplementation, the circuit can work as an illumination regulator, its construction being possible with only one inexpensive quadruple operational amplifier, with the capability of driving practically any number of ballasts. With incident daylight, the illumination regulator adjusts the light flux to lesser values, or it can even turn off the lamps including the heating system.

Proper functioning of the circuit arrangement according to the invention requires the availability of a dc voltage being as constant and shortcircuit-proof as possible to feed all ballasts. In accordance with yet an additional feature of the invention, there is provided a rectifier having a power input filter for receiving line voltage and converting the line voltage into the dc voltage, an uncontrolled diode bridge connected to the rectifier, a dc voltage smoothing member connected to the diode bridge, a current measuring device connected to the diode bridge for measuring actual dc current, a dc voltage measuring device connected to the diode bridge for measuring actual dc voltage, and a direct current switch connected to the diode bridge for inhibiting the direct current upon the occurance of any one of undervoltage, excess current and short circuit. The uncontrolled rectification permits a slight phase shift between line current and line voltage. The measuring devices permit shutting off the frequency generator in case it has fallen below the voltage level required for proper operation of the lamps, and shutting off the dc voltage in case of excess current or short circuit, as may occur when replacing a defective lamp, for instance.

In accordance with still a further feature of the invention, the direct current switch is in the form of a further thyristor having a control electrode for turning the further thyristor on and off. The use of such a thyristor considerably simplifies the construction of the circuit arrangement.

To prevent overloading of components due to repeated closing of the dc switch, in accordance with still another feature of the invention, there are provided switch prevention means, such as a timer, connected to the direct current switch for preventing the direct current switch from being turned on again for a given time span after having been turned off. To monitor this device, in accordance with still an added feature of the invention, there is provided a counter or timing element in the form of means connected between the switch prevention means and the direct current switch for preventing further starting attempts after a given number of unsuccessful attempts at again turning on the direct current switch. This device acts as an electronic fuse which must be returned to its normal state by a special restarting key or by brief actuation of the power switch.

In order to be able to stabilize variations in the dc voltage due to line voltage or connected-load fluctuations, in accordance with a concomitant feature of the invention there are provided means for locking disturbing variables of the actual dc voltage on to the frequency generator for increasing the frequency with decreasing dc voltage and for decreasing the frequency with increasing dc voltage. For the present application, the disturbance variable lock-on is more economical than keeping the dc voltage constant by means of power control devices.

Other features which are considered as characteristic for the invention are set forth in the appended claims.

Although the invention is illustrated and described herein as embodied in a method and circuit arrangement for heating and igniting as well as controlling or regulating the light flux of low-pressure gas-discharge lamps, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
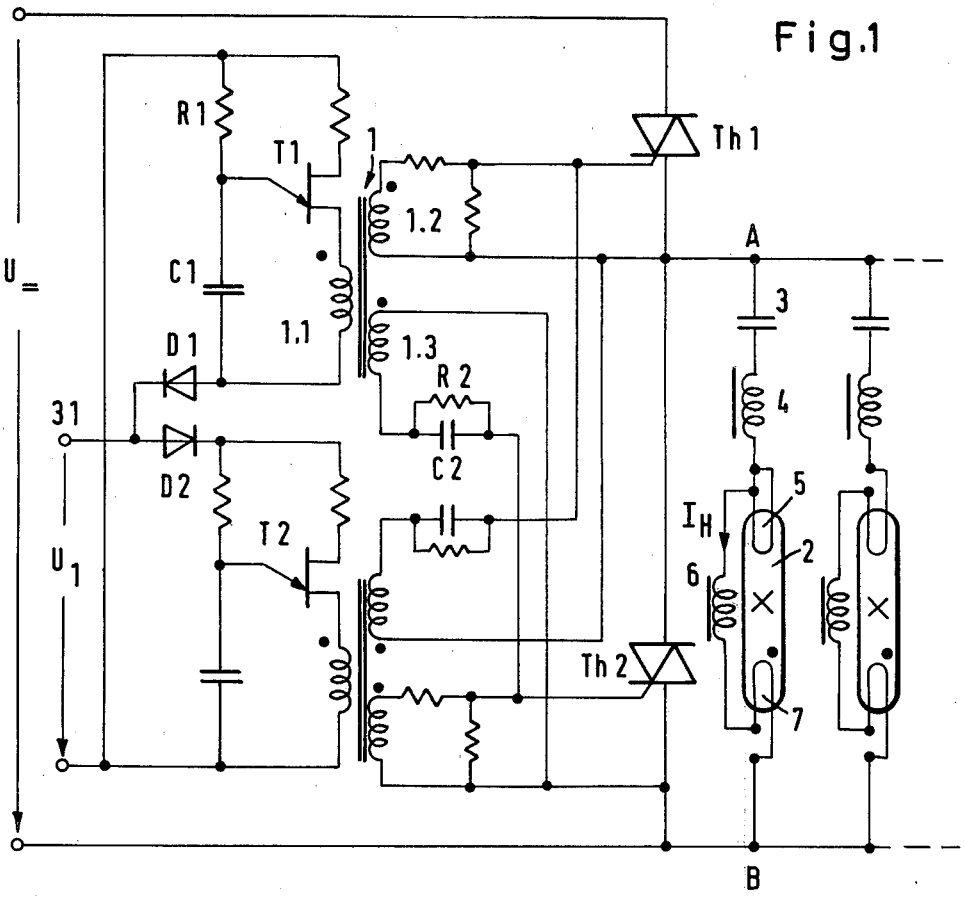
FIG. 1 is a schematic electric circuit diagram of a ballast with an ignition pulse generator, an inverter, series-connected LC-members, shunt chokes, and fluorescent lamps.

Referring now to the figures of the drawing and first particularly to FIG. 1 thereof, it may be seen from the circuit diagram of a ballast shown therein, that the inverter is formed of two series-connected backwardly conducting thyristors Th1, Th2 disposed between the terminal poles of a dc supply voltage $U_=$. Associated with each thyristor Th1, Th2 is a separate ignition pulse generator which generates ignition pulses to fire the thyristors Th1, Th2 alternately, from an ac ignition pulse voltage U1 applied to a terminal 31. Each pulse generator has a decoupling diode D1, D2 and a unijunction transistor T1, T2, having the primary winding 1.1 of an ignition transformer 1 inserted into the main circuit thereof. The main thyristor Th1 is coupled to a first secondary winding 1.2 of the ignition transformer. The ignition pulses for the main thyristor Th1 are formed by means of an RC member R1, C1 connected to the control electrode of the transistor T1, T2. Short inhibiting pulses are applied to the control electrode of the other main thyristor Th2 by means of a second secondary winding 1.3 and by means of a parallel RC member R2, C2. These inhibiting pulses increase the voltage rise resistance of the respectively blocked thyristor so that thyristors which are not specifically constructed for high voltage-rise resistance can also be used.

Due to the alternate firing of the thyristors Th1, Th2, a square-wave voltage, having a maximum which equals the dc voltage $U_=$ and a minimum which equals zero, appears at a junction point A of the two thyristors.

Practically any desired number of fluorescent lamps 2 and free ends of heating coils 5, 7 which are interconnected through a second choke 6, are connected between the two output terminals A, B through a ballast LC member including a capacitor 3 and a first choke 4. The capacitor 3 and the two chokes 4, 6 are tuned to each other in such a way, that considering the dc voltage $U_=$ and the frequency of the square-wave ac voltage at the output A, the fluorescent lamp 2 will not ignite at the lower frequency limit while a heating current $I_H$ sufficient for correct heating flows through the heating coils 5, 7 and the second choke 6 connecting them. Furthermore, with increasing frequency, the lamp voltage $U_L$ between the two heating coils 5, 7 rises enough for the gas discharge gap to be fired, the heating current $I_H$ remaining unchanged at first, until the light flux of the fluorescent lamp 2 has reached about 40% of its rated value, and as the frequency continues to increase, the heating current $I_H$ decreases steadily, receding to less than 25% of its initial value at 100% light flux.

Due to the fact that each fluorescent lamp 2 is given its own series capacitor 3, all lamps will shine with the same brightness when the brightness control is turned down, even if the firing voltage varies. Since the frequency is high relative to the line frequency, even standard fluorescent lamps will still burn without flickering at only 1% of the rated light flux, because twice the dc voltage $U_=$ is available as the ignition voltage. For the same reason, the new fluorescent lamps of smaller diameter and higher light yield can be used to advantage, although their firing and operating voltages are higher than those of the heretofore used, conventional fluorescent lamps of larger diameter. Contact resistances at the lamp sockets remain without influence because they are very small compared to the total resistance in the circuit.

Figure 2:
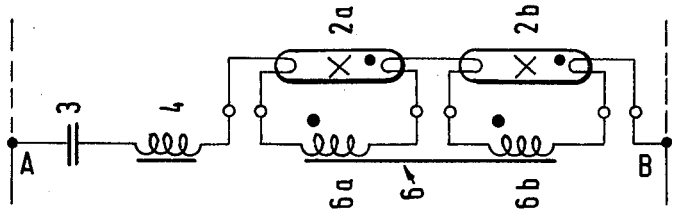
FIG. 2 is a schematic electric circuit diagram for the case involving two series-connected fluorescent lamps of less output rating.

FIG. 2 shows a series circuit of two fluorescent lamps 2*a*, 2*b* with a single capacitor 3 and a single first choke 4. The second choke 6 has two windings 6*a*, 6*b*, each being shunted across one fluorescent lamp 2*a*, 2*b*, respectively.

Figure 3:
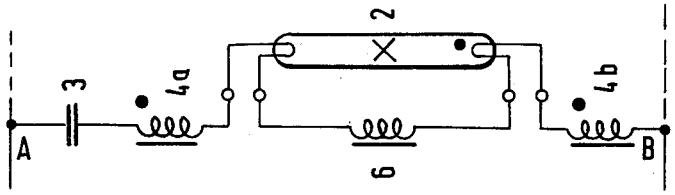
FIG. 3 is an electric circuit diagram similar to FIG. 2 for the case involving a ballast or power supply or connecting device with split series choke.

FIG. 3 shows another arrangement with a fluorescent lamp 2 and a second choke 6, with a single capacitor 3 and two first chokes 4*a*, 4*b*, one choke 4*a* being connected ahead of, and the other choke 4*b* being connected behind, the fluorescent lamp 2. This prevents radio interference possibly emanating from the inverter, from reaching the fluorescent lamp 2 unhindered, and inversely prevents radio interference generated in the lamp 2 from reaching the inverter and the wiring unhindered.

Figure 4:
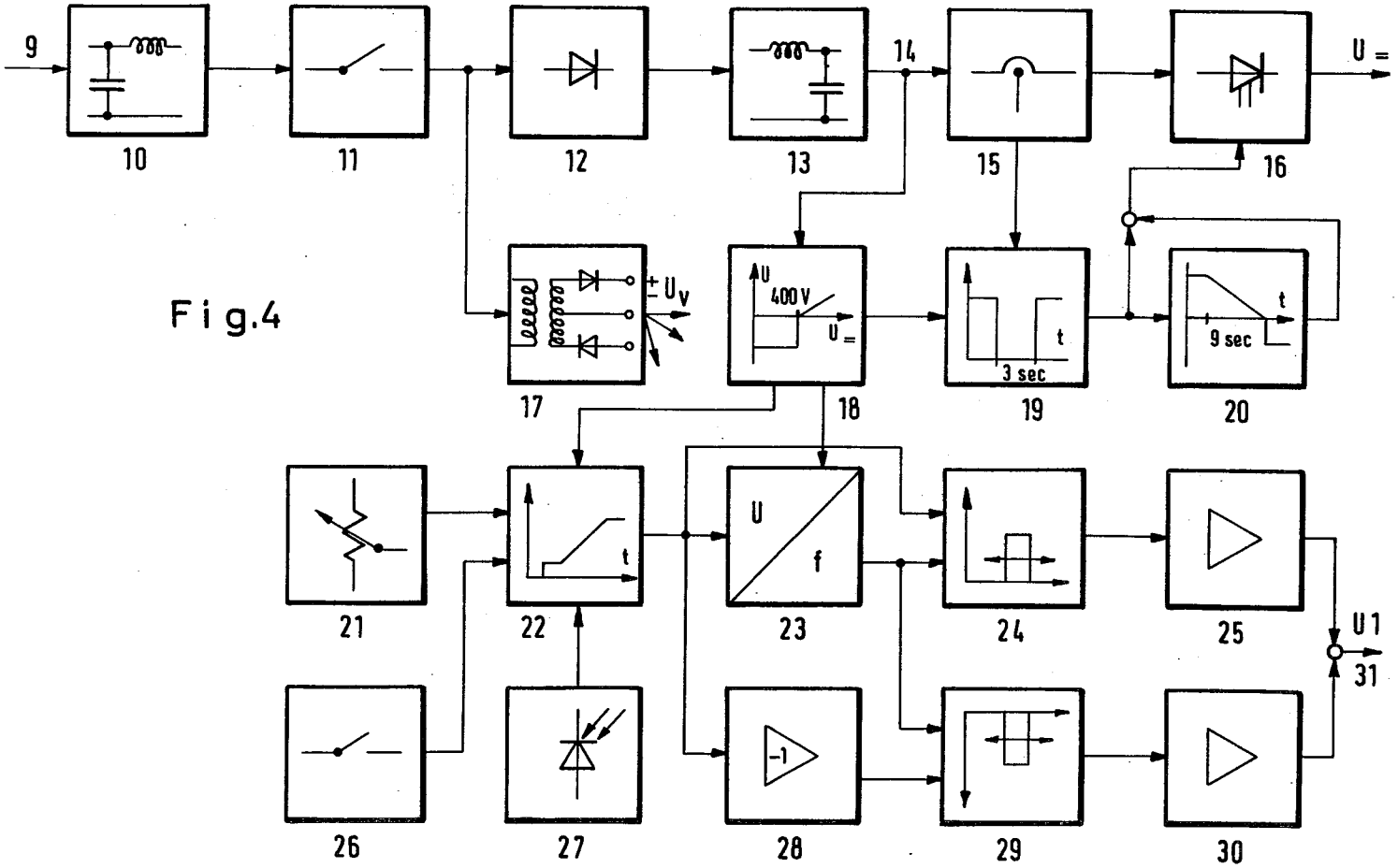
FIG. 4 is a block circuit diagram for the generation of the dc feed voltage from an ac network with the associated control and protective circuits, and for the generation of the ac ignition pulse voltage with variable frequency corresponding to the light flux.

The block circuit diagram of FIG. 4 shows an embodiment of a rectifier circuit, to be disposed centrally, for generating a dc supply voltage $U_=$ from the public supply network, the associated test, control and protective devices, and an embodiment example of the electronics for generating the ac ignition pulse voltage U1, the frequency of which is a measure of the light flux radiated by the fluorescent lamps, as already mentioned repeatedly. The electric energy from a public supply network 9, which may be a single or three-phase network, reaches an uncontrolled rectifier bridge 12 through a line input filter 10 and a power switch 11, where it is transformed into a dc voltage. The dc voltage is smoothed in a smoothing member 13 and measured in a voltage measuring device 14. A current measuring device 15 measures the magnitude of the flowing direct current. Downstream of an undervoltage and short circuit circuit breaker 16, the dc voltage $U_=$ is available for distribution to the ballasts associated with the various fluorescent lamps. The actual value of the dc voltage measured by the device 14 is processed in a dc voltage evaluating circuit 18 in the form of a function generator. The characteristic of the circuit 18 is chosen in such a way that a negative inhibiting signal is transmitted below a certain minimum voltage, e.g. 400 V, which trips the undervoltage and short circuit circuit breaker 16 through a timing element 19. The timing element 19 sees to it that the breaker 16 stays locked for a certain period of time, e.g. 3 sec. The timing element 19 is activated not only by undervoltage, but also by excess current measured by the current measuring device 15. If the current in the dc circuit exceeds the rated current or if a short circuit occurs, the breaker 16 will interrupt the current within 1 to 2 μsec. Due to the action of the choke in the smoothing member 13, the current will rise only slightly above the rated current within the turn-off time. After the lapse of the delay period of about 3 sec., the timing member 19 recloses the breaker 16.

In case of a permanent short circuit, the breaker 16 is immediately tripped again. To prevent constant turning on and off, a monitoring and safety circuit 20 is provided, which permanently shuts off the breaker 16 after a certain number of unsuccessful restarting attempts, such as 3 or 5. To be able to operate the system again after the elimination of the short circuit, the line switch 11 must be actuated briefly. However, it is also possible to provide a restarting button in the monitoring and safety circuit 20 itself.

The electronic device for the generation of the ac ignition pulse voltage U1 includes function units 21 and 30. The desired light flux value set on a desired light flux control or illumination control 21, travels to frequency starting-up generator 22 with a characteristic of an essentially integrating nature. In its lower range, the characteristic is modified in such a way that the output signal of the frequency starting-up generator 22 remains constant for a certain period of time. This time span serves the purpose of preheating the heating coils in the fluorescent lamps to permit an unflickering start of the gas discharge. The output signal of the frequency starting-up generator 22 is transformed into an ac voltage in a voltage/frequency converter 23, the frequency of which is proportional to the voltage applied. The positive part of the ac voltage arrives at a pulse former 14 for positive ignition pulses. The output voltage of the frequency starting-up generator 22 is also applied to the pulse former 24. By comparing the two voltages in the pulse former, the length of the individual pulses is caused to be inversely proportional to the frequency. At 100% light flux, the ignition pulse length is about 4 μsec.; at less than 20% light flux it is about 20 μsec. The ignition pulses reach the ignition pulse line 31 through an ignition pulse amplifier 25, for conduction to the various ballasts.

The negative component of the ac voltage at the output of the voltage/frequency converter 23, arrives at an ignition pulse former 29 for negative ignition pulses. The output voltage of the frequency starting-up generator 22, after being inverted by an inverter 28, is applied to the second input of the ignition pulse former 29. The length-modulated negative ignition pulses also reach the ignition pulse line 31 through an ignition pulse amplifier 30. The sum of positive and negative ignition pulses constitutes the ac ignition pulse voltage U1.

Both the frequency starting-up generator 22 and the voltage/frequency converter 23 are modulated by the actual dc voltage $U_{=}$ prepared in the function generator 18 in such a way that the frequency f becomes lower with rising voltage and higher with dropping voltage. If this interference variable lock-on is properly adjusted, neither voltage fluctuations in the network 9 nor ripples of the dc voltage $U_{=}$ will affect the lighting intensity.

By means of a switch 26, the accelerator or generator 22 can be turned on and off directly without needing to actuate the line switch 11.

By means of a light flux sensor 27, the actual light flux radiated by the fluorescent lamps can be measured and regulated to a constant value.

A voltage source 17 generates the operating voltages $\pm U_V$ for the electronics component.

Figure 5:
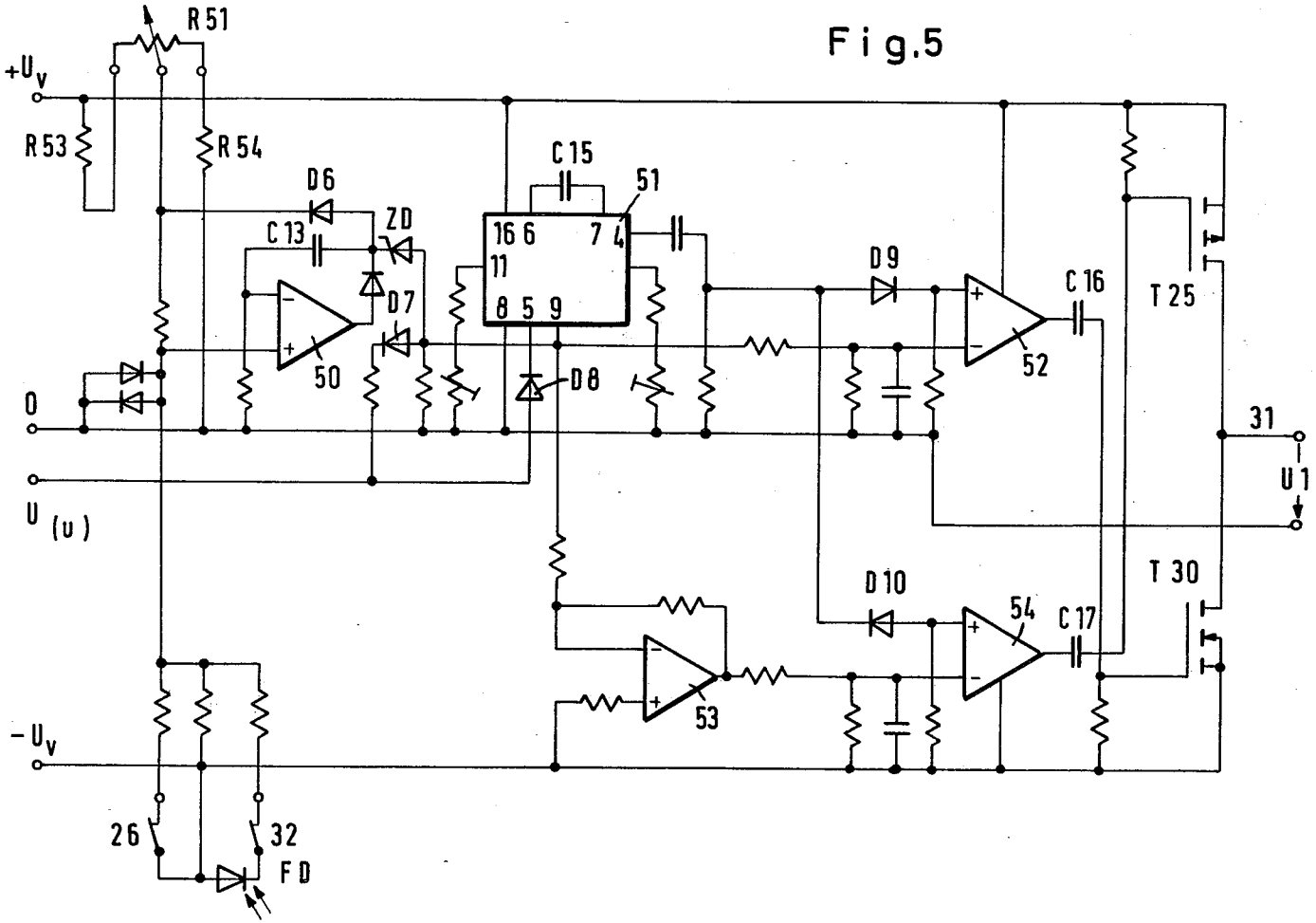
FIG. 5 is a schematic electric circuit diagram of a circuit for the generation of the ac ignition pulse voltage corresponding to the desired theoretical value, with additional possibilities for regulating the light flux and locking on disturbing variables to equalize voltage fluctuations.

FIG. 5 shows a circuit diagram of the electronics component generating the ac ignition pulse voltage U1. A desired-value potentiometer R51 for setting the desired light flux is shown. The maximum and minimum brightness can be predetermined by means of resistors R53 and R54.

Together with a capacitor C13, an operational amplifier 50 forms an integrating member according to the characteristic of the frequency starting-up generator 22 of FIG. 4. Because of the clamping diode D6, the output voltage of the operational amplifier 50 cannot exceed the value set on the wiper of the desired-value potentiometer R51. The output voltage of the operational amplifier 50 reaches the control input of a voltage-controlled oscillator component 51 through a Zener diode ZD. The basic frequency of the oscillator 51 is set by means of a capacitor C15. In order for the output voltage of the operational amplifier 50 to be effective at the input of the voltage-controlled oscillator 51, it must have risen above the threshold voltage of the Zener diode ZD. The modification of the lower range of the characteristic of the frequency starting-up generator 22 in FIG. 4 is thus achieved by means of the Zener diode ZD.

From the output of the voltage-controlled oscillator component 51, the positive half-wave arrives through a diode D9, at an operational amplifier 52 wired as comparator. The second input of the amplifier 52 receives the output voltage of the operational amplifier 50. Square pulses having widths being antiproportional to the frequency, are generated in the operational amplifier 52. The pulses are coupled to an amplifier/transistor T30 through a coupling capacitor C16; they are amplified there and led to the ignition pulse line 31.

The negative part of the output voltage of the voltage-controlled oscillator component 51 is fed through a diode D10 and arrives at an operational amplifier 54, likewise wired as comparator. The second input of the amplifier 54 receives the output voltage of the operational amplifier 50, after being inverted in an operational amplifier 53 wired as an inverter. The operating mode of the comparator 54 corresponds exactly to that of the comparator 52, the negative pulses reaching the ignition pulse line 31 through a coupling capacitor C17 and an amplifying transistor T25.

Through a coupling diode D7, a control voltage $U_{(U)}$ depending on the dc voltage $U_{=}$ is locked on to the operational amplifier 50 working as the starting-up generator. Through another coupling diode D8, the dc voltage-dependent measured voltage $U_{(U)}$ is also transmitted to the voltage-controlled oscillator component 51, where it changes the output frequency inversely proportionally to the measured value.

The switch 26 is provided for turning on the frequency starting-up generator. A photodiode FD can be added to the starting-up generator by a switch 32 so that it is then possible to adjust the light flux of the fluorescent lamps to a constant value.

Figure 6:
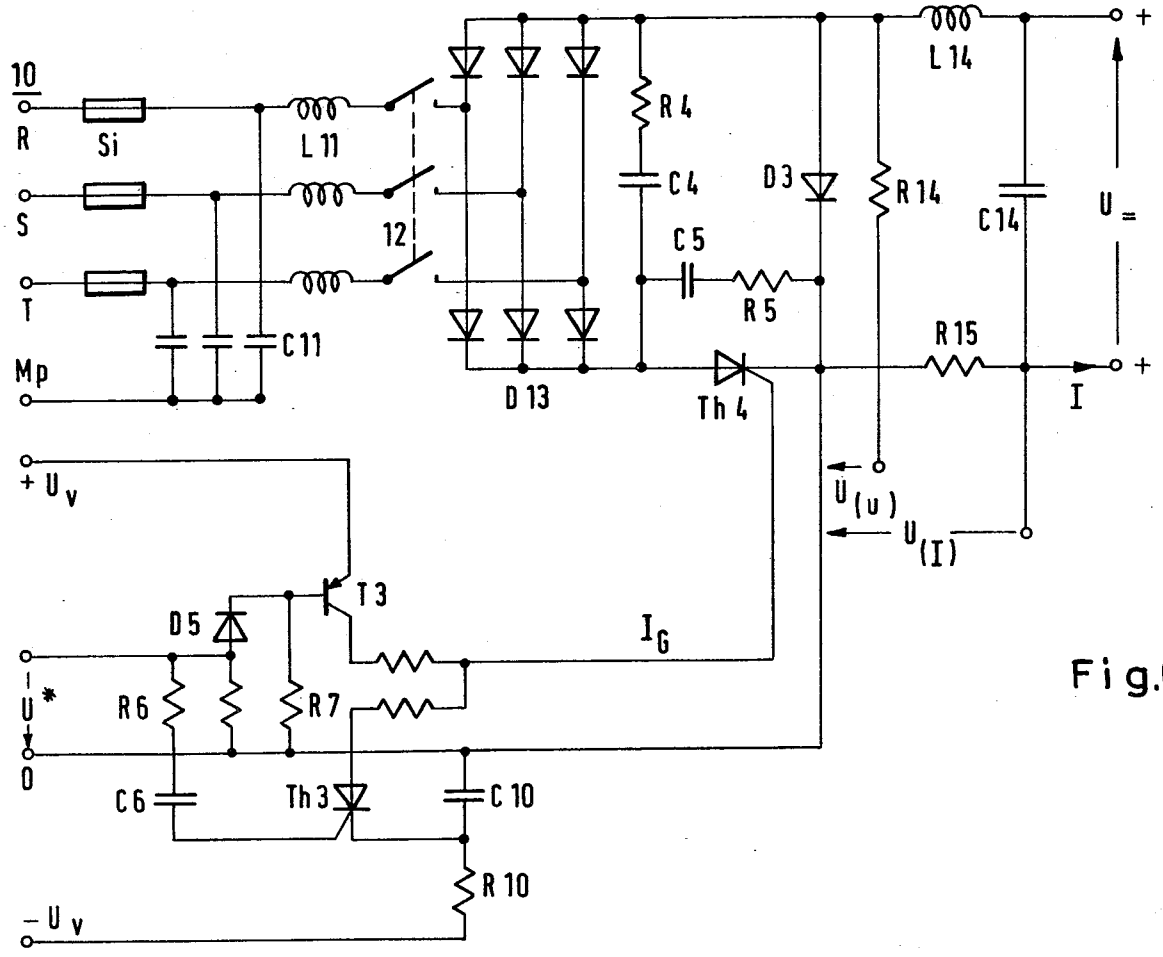
FIG. 6 is a schematic electric circuit diagram of a rectifier circuit, to be centrally disposed, for the generation of the dc voltage feeding the ballasts, with an additional circuit to protect against undervoltages, excess currents and short circuits.

FIG. 6 shows the circuit diagram of an embodiment of the rectifier circuit. Electric energy from a four-wire three-phase network 10 with terminals R, S, T and Mp, arrives at the uncontrolled rectifier bridge having diodes D13, through a fuse Si and a line input filter with a capacitor C11 and a choke L11 and through a line switch 12 of each phase. The use of an uncontrolled rectifier bridge in connection with the line input filter makes it possible to draw current with little or no phase shift from the three-phase network 10. Connected to the output of the rectifier bridge D13, is an RC interference suppression member R4, C4 and a smoothing member with a choke L14 and a capacitor C14. The dc supply voltage $U_=$ appears at the capacitor C14.

The direct current I formed in the rectifier bridge D13 flows through a thyristor Th4 with a parallel-connected interference suppressor C5, R5, and through current-measuring resistor R15, across which the measured voltage drop $U_{(I)}$ appears. The magnitude of the dc voltage $U_=$ is picked up by a resistor R14, the output of which carries the measured voltage $U_{(U)}$.

The thyristor Th4, acting as an undervoltage and short circuit protector, involves a thyristor which can be turned on and off through its control electrode. The control electrode current $I_G$ required for turning the thyristor on and off is formed in a circuit with a PNP transistor T3 and a thyristor Th3. The starting current is furnished by the positive pole of the supply voltage $U_V$, through the transistor T3 which is switched into conductance by a resistor R7. In order to turn off the transistor T3, a current and voltage-dependent control voltage U* is used. The voltage U* is formed by combining the current-dependent measured voltage $U_{(I)}$ and the voltage-dependent measured voltage $U_{(U)}$, and it is coupled to the base of the transistor T3 through a diode D5.

The current and voltage-dependent control voltage U* inhibiting the transistor T3 is also fed to the control electrode of the thyristor Th3 through a coupling RC-member R6, C6, whereupon the thyristor Th3 becomes conducting. At this moment, the inhibiting pulse capacitor C10, which is charged through a resistor R10, drives a negative control electrode current $I_G$ across the control path of the thyristor Th4, whereupon it shuts off. As soon as the capacitor C10 is discharged, the thyristor Th3 is cut off again and the capacitor C10 recharges through the resistor R10. After the lapse of a certain time span of, say, 3 sec., the current and voltage-dependent control voltage U* disappears again, whereupon the transistor, and therefore the thyristor Th4, are turned on again.

Figure 7:
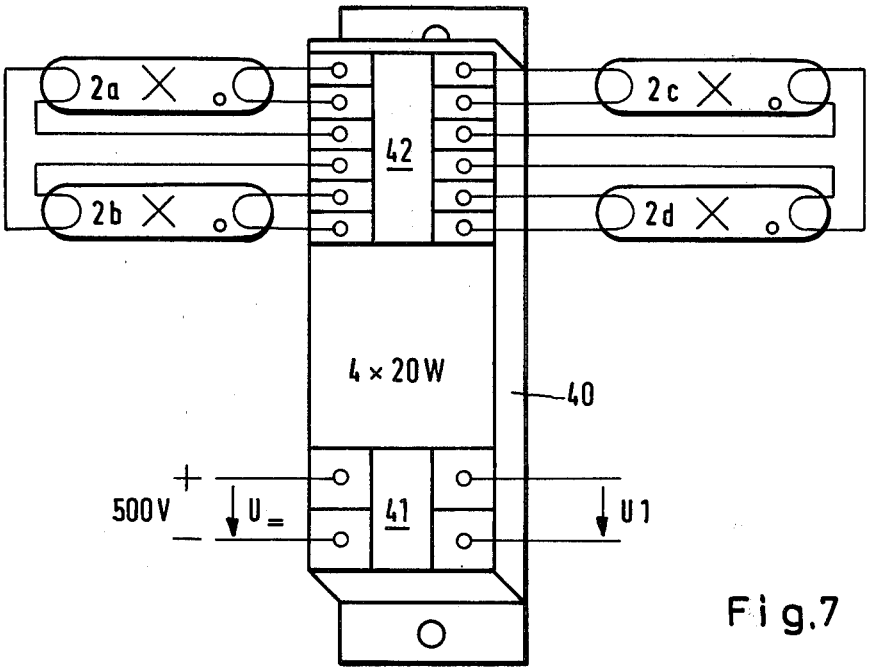
FIG. 7 is a diagrammatic perspective view of a ballast for the connection of four low-wattage fluorescent lamps.

FIG. 7 is a view of the outside of a ballast for the connection of four fluorescent lamps, each two of which are series-connected. There is seen a housing 40 having a terminal strip 41 fastened to one end thereof. The dc voltage $U_=$ of 500 V, for instance, as well as the ac ignition pulse voltage U1 are applied to the terminal strip 41. Another terminal strip 42 is fastened to the other housing end, with the connecting contacts of the four fluorescent lamps *2a*, *2b*, *2c* and *2d* leading therto. Inside the housing 40 are the thyristors of the inverter which, due to the small power loss, only require small cooling fins; the ignition transformers with the associated electronics; and the series capacitors and chokes for the fluorescent lamps.

Figure 8:
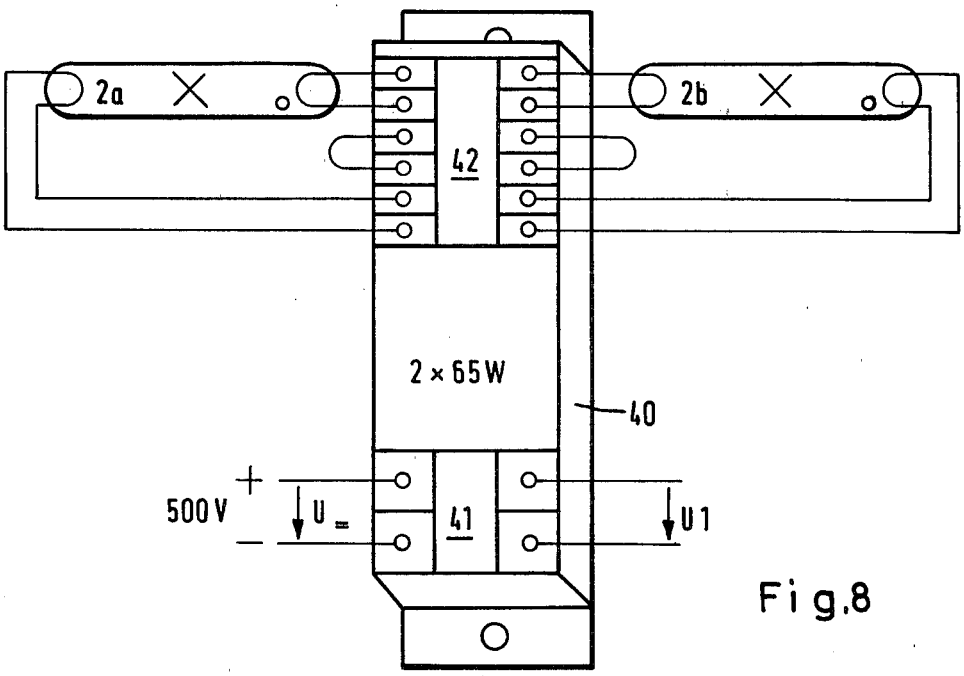
FIG. 8 is a view similar to FIG. 7 of a ballast for the connection of two high-wattage fluorescent lamps.

FIG. 8 shows the outside view of a ballast for two fluorescent lamps. The construction is identical with that of FIG. 7. The outside dimensions of the housing 40 are in harmony with the dimensions of the lighting fixture. On principle, all fluorescent lamps between 20 and 65 W energy consumption can be operated with one ballast without modification because the lamp output is adjustable through the selection of the highest frequency of the ac ignition pulse voltage U1. This reduces the number of different types and thus the cost. The uncluttered terminal strips permit clear coordination of the lamp sockets.

The diagrams of FIGS. 9 to 13 each show, as a function of the light flux L which is given in a percentage of the rated value, different measured values obtained in the operation of different fluorescent lamps on a ballast constructed in accordance with the invention.

Figure 9:
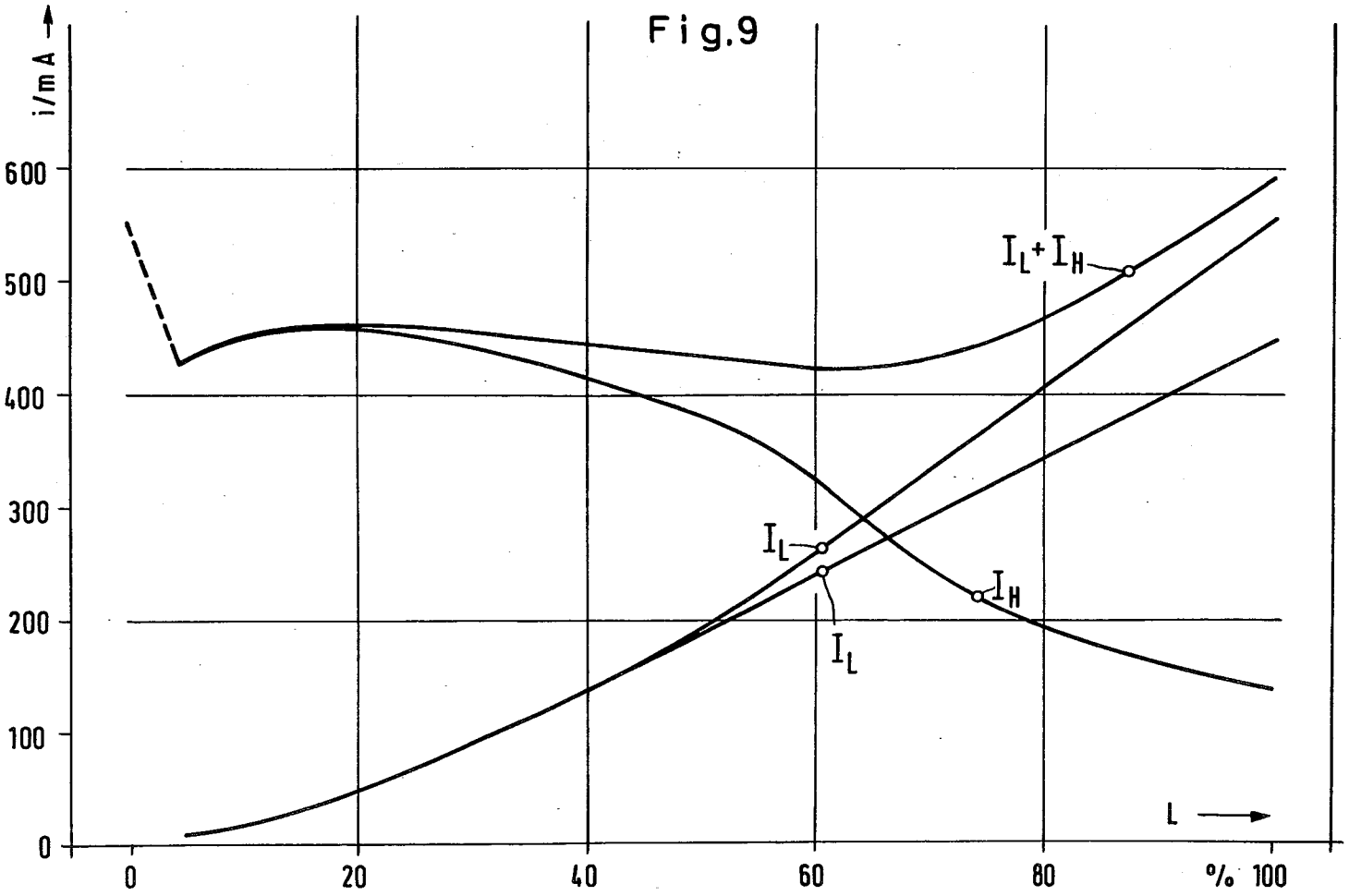
FIGS. 9 to 13 are graphical illustrations of test curves taken on devices according to the invention, with voltage, current, frequency and power consumption values plotted as they appear at a certain light flux.

According to FIG. 9, at 0% light flux L, the heating current $I_H$ and the total current $I_H+I_L$ are the same. After the ignition of the lamp at 5% of the light flux L, the lamp current $I_L$ increases, whereas the heating current $I_H$ remains essentially constant at first. The total current $I_L+I_H$ flows through the first heating coils and the gas discharge path of the fluorescent lamp to the second heating coil. The arithmetic mean of the lamp current $I_L$, corresponding to the current through the gas discharge path, increases linearly with the light flux L. The phase shift between the total current and the heating current increases with increasing light flux.

Figure 10:
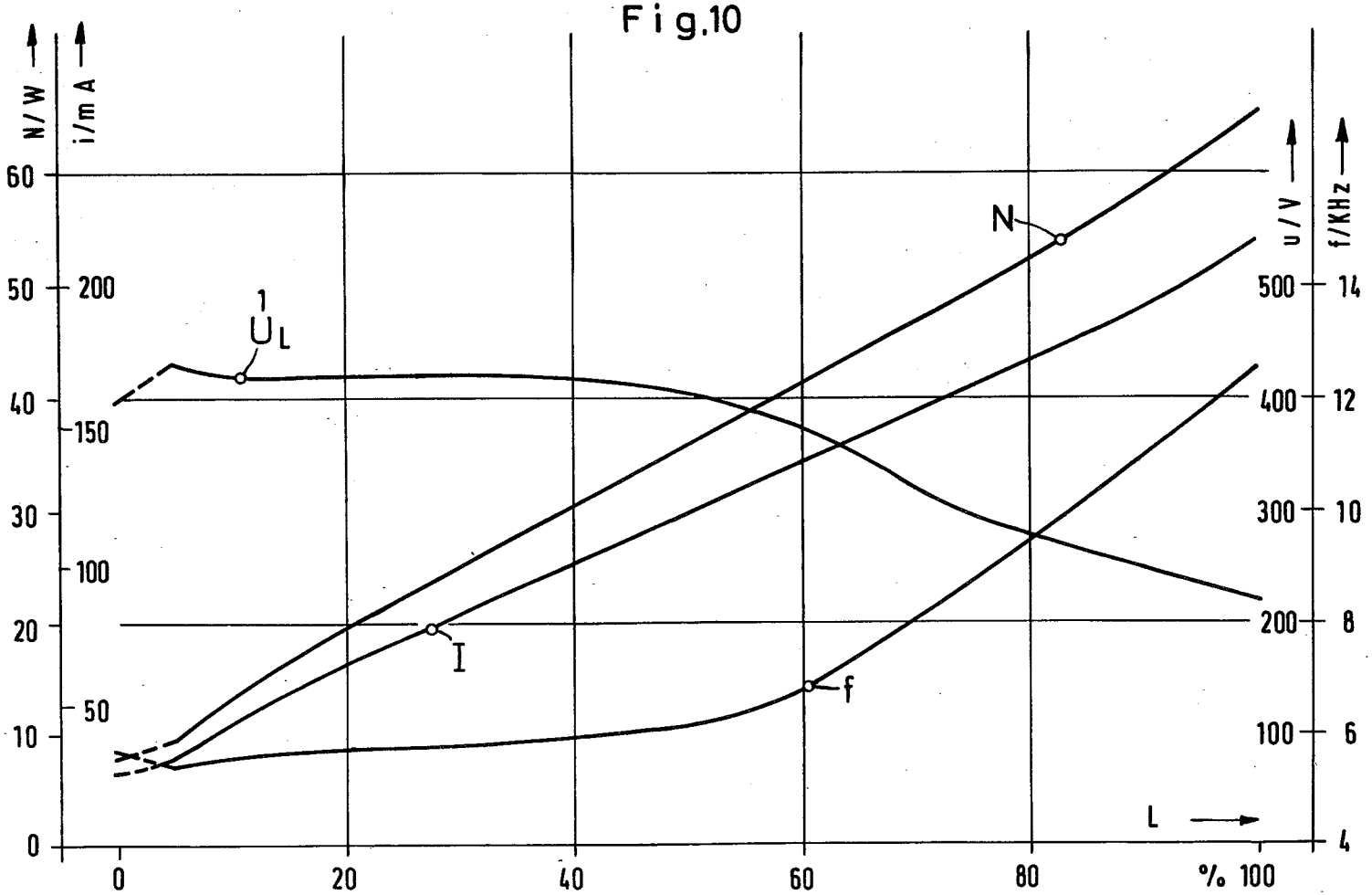

FIG. 10 shows, for a 65 W fluorescent lamp, the energy consumption N in watts, the flowing direct current I in milliamperes, the lamp voltage $U_L$ in volts, and the frequency f in kilohertz, as a function of the light flux L. The lamp voltage $U_L$ is the peak voltage between the heating coil centers. Before the lamp ignites, the peak lamp voltage is 400 V. The lamp reignition voltage remains constant at 420 V up to 40% of the light flux and drops to 220 V at 100% light flux. From 20% to 100% light flux, the dc current I and the total power input N increase almost linearly. The power consumption for heating the heating coils before the lamp ignites is 8 W.

Figure 11:
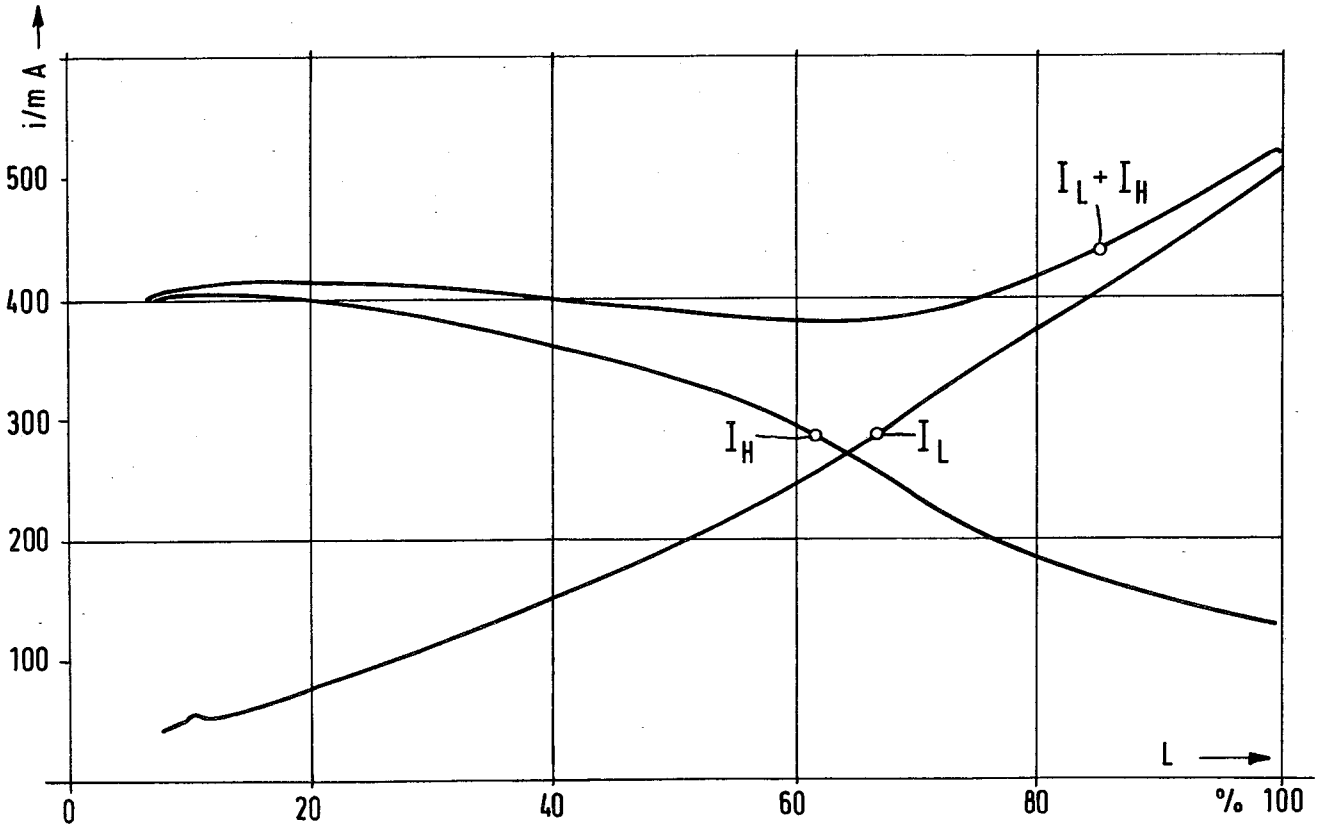

FIG. 11 shows the root-mean square (rms) values of the heating current $I_H$, the lamp current $I_L$, and the total current $I_L+I_H$ as a function of the light flux L, for the same 65 W fluorescent lamp.

Figure 12:
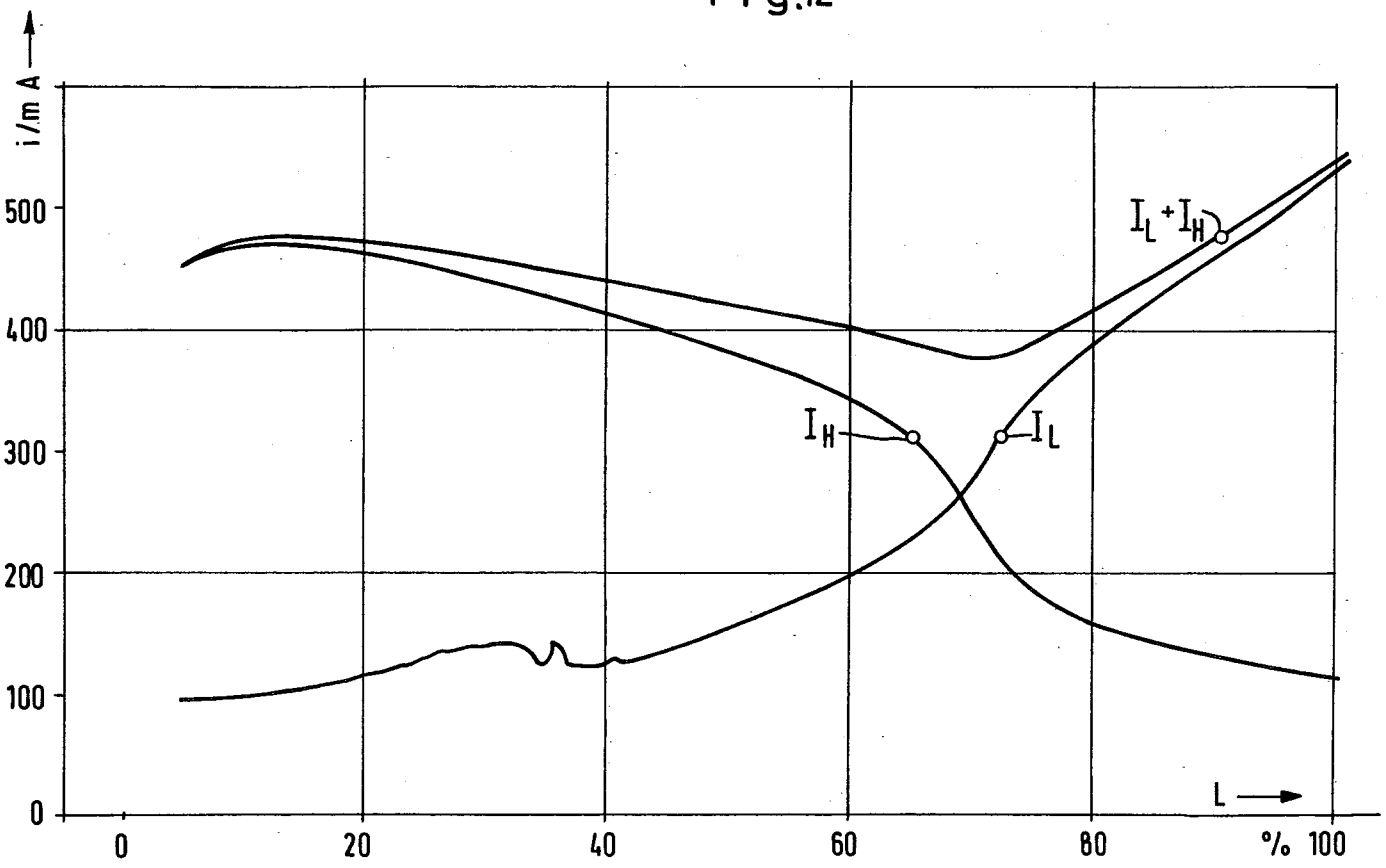

FIG. 12 shows the corresponding measured values for a 58 W fluorescent lamp.

Figure 13:
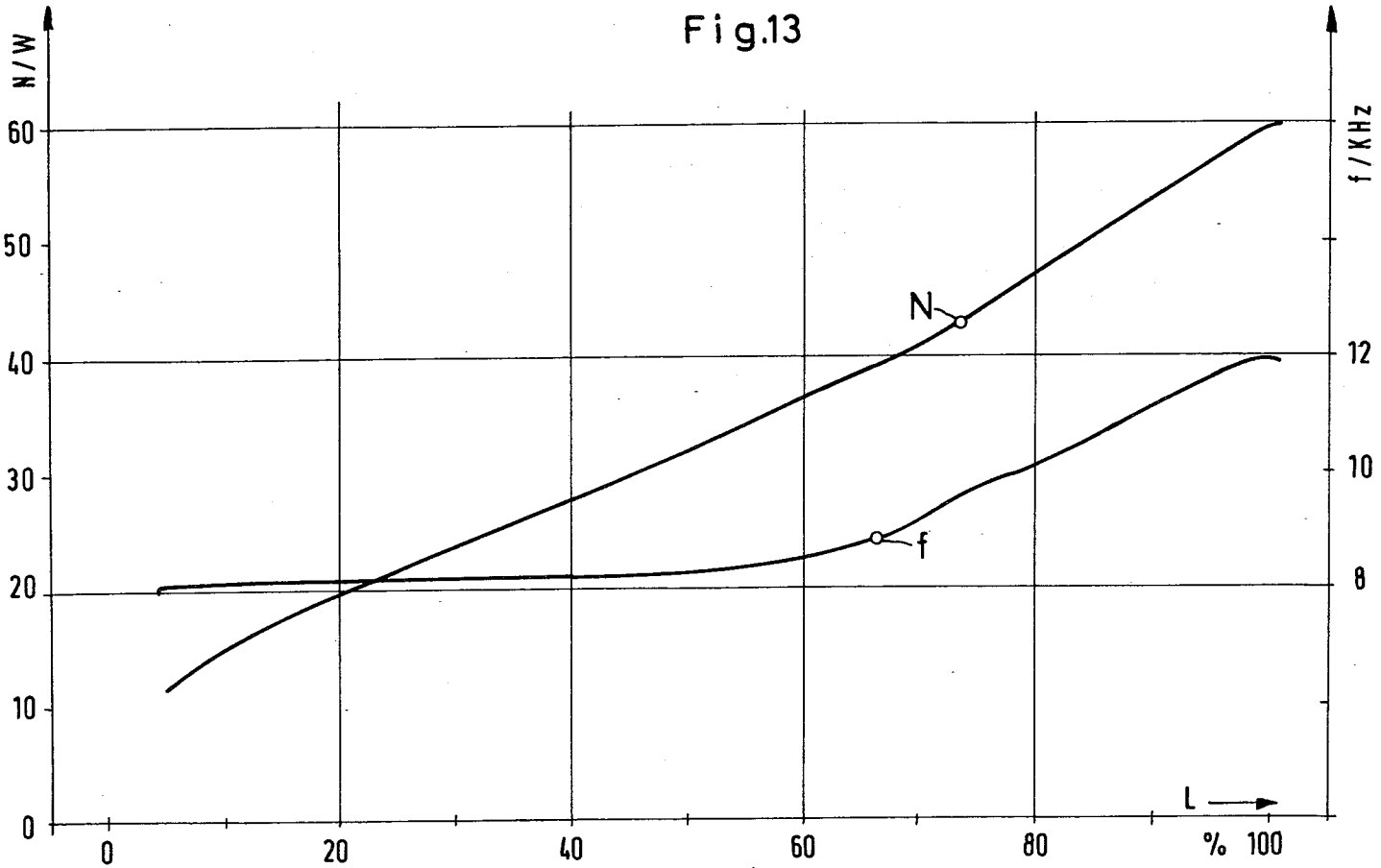

For the same 58 W fluorescent lamp, FIG. 13 shows the power input N in watts and the frequency f in kilohertz, as a function of the light flux L. It is clear that while the different types of fluorescent lamps yield different test curves, the curves coincide in principle, and all types of fluorescent lamps can be operated with the same ballast.

I claim:

1. Method for heating and igniting as well as controlling or regulating the light flux of low-pressure gas-discharge lamps, including a ballast having an inverter for generating an ac voltage at inverter output terminals from a dc voltage generated from an ac supply network by rectifiers, the ac voltage having a frequency higher than line frequency, the ballast including an L-C circuit having a capacitor and a first choke connected between one of the inverter output terminals and a lamp, the lamp being in turn connected to another of the inverter output terminals, a second choke shunted across the lamp, the charge of the capacitor being constantly reversed by the inverter with controllable frequency, which comprises changing the inverter frequency in accordance with the desired light flux with constant ac voltage amplitude at the outputs of the inverter, tuning the frequency, voltage, capacitor, first choke and second choke to each other, circulating substantially the required heating current through heating coils of the lamp at low frequency before the lamp is ignited, decreasing the heating current at rising frequency until substantially 40% of the rated light flux of the lamp is reached after the lamp is ignited, and decreasing the heating current to less than 25% of its initial value as the frequency continues to rise until the rated light flux of the lamp is reached.

2. Method according to claim 1, which comprises keeping the frequency constant at a given low value for a given time span after turning on the ballast until the heating coils reach their required temperature, and subsequently increasing the frequency to a value corresponding to the desired light flux.

3. Circuit for carrying out a method for heating and igniting as well as controlling or regulating the light flux of low-pressure gas-discharge lamps according to claim 1, each lamp having two heating coils each having two terminals, comprising an inverter having output terminals for converting a dc voltage into an ac voltage of higher frequency at said output terminals, said inverter including two semiconductor switches receiving the dc voltage and being connected together in series and two antiparallel connected diodes each being respectively connected to one of said switches, one of said inverter output terminals being connected to one terminal of one coil of a lamp, at least one series circuit for increasing lamp current through the lamp with increasing frequency and for decreasing heating current through the heating coils of the lamp, each of said at least one series circuit including a first choke, and a capacitor connected in series between another of said inverter output terminals and one terminal of the other coil of the lamp, a second choke shunted across the other terminals of the coils of the lamp, and at least one frequency generator connected to said inverter for generating an ac ignition pulse voltage as a function of a given desired light flux for alternately switching said switches on and off.

4. Circuit according to claim 3, wherein said semiconductor switches are thyristors and said at least one frequency generator is in the form of two ignition pulse generators respectively forming and delivering the ac ignition pulse voltage as ignition pulses to one of said thyristors, each of said ignition pulse generators including a decoupling diode separating positive and negative parts of the ac ignition pulse voltage, a unijunction transistor having a power circuit and a resistor and a capacitor connected to said decoupling diode, and an ignition transformer having a primary winding connected to the power circuit of said unijunction transistor, and a secondary winding connected to said respective thyristor for furnishing ignition pulses thereto formed from the ac ignition pulse voltage.

5. Circuit according to claim 4, wherein each of said ignition transformers has another secondary winding, and including two parallel-connected RC-members each being connected between one of said other secondary windings and said thyristor connected to said other respective transformer.

6. Circuit according to claim 4 or 5, wherein said respective thyristor and antiparallel-connected diode are in the form of backward conducting thyristors.

7. Circuit according to claim 3 or 4, wherein said first choke is split into two choke parts, one of said choke parts being disposed upstream of the lamp and the other being disposed downstream thereof.

8. Circuit according to claim 3 or 4, wherein said first choke has two windings, one of said windings being disposed upstream of the lamp and the other being disposed downstream thereof.

9. Circuit according to claim 3 or 4, wherein at least one other lamp is connected in series with the first-mentioned lamp, and said second choke is split into two choke parts, each one of said choke parts being shunted across a respective one of the lamps.

10. Circuit according to claim 3 or 4, wherein at least one other lamp is connected in series with the first-mentioned lamp, and said second choke includes a plurality of windings, each one of said windings being shunted across a respective one of the lamps.

11. Circuit according to claim 3 or 4, including a potentiometer for setting a desired light flux of the lamp, and an integrating control connected to said potentiometer and to said frequency generator for driving said frequency generator with a defined acceleration curve.

12. Circuit according to claim 11, wherein said frequency generator is in the form of a voltage-controlled pulse generator forming voltage blocks of alternating polarity and a pulse width inversely proportional to the frequency.

13. Circuit according to claim 3 or 4, including a light-sensitive component for measuring actual light flux of the lamp, and an integrating control connected to said light-sensitive component and said inverter for comparing desired and actual light flux.

14. Circuit according to claim 3 or 4, including a rectifier for receiving line voltage and converting the line voltage into the dc voltage, a power input filter connected to said rectifier, an uncontrolled diode bridge connected to said rectifier, a dc voltage smoothing member connected to said diode bridge, a current measuring device connected to said diode bridge for measuring actual dc durrent, a dc voltage measuring device connected to said diode bridge for measuring actual dc voltage, and a direct current switch connected to said diode bridge for inhibiting the direct current upon the occurence of any one of undervoltage, excess current and short circuit.

15. Circuit according to claim 14, wherein said direct current switch is in the form of a further thyristor having a control electrode for turning said further thyristor on and off.

16. Circuit according to claim 14, including switch prevention means connected to said direct current switch for preventing said direct current switch from being turned on again for a given time span after having been turned off.

17. Circuit according to claim 16, including means connected between said switch prevention means and said direct current switch for preventing further starting attempts after a given number of unsuccessful attempts at again turning on said direct current switch.

18. Circuit according to claim 3, including means for locking disturbing variables of the actual dc voltage on to said frequency generator for increasing the frequency with decreasing dc voltage and for decreasing the frequency with increasing dc voltage.

* * * * *